United States Patent [19]

Slany

[11] 3,978,875

[45] Sept. 7, 1976

[54] DISH WASHING MACHINE

[76] Inventor: Erich Hans Slany, Muelbergerstr. 90, 7300 Esslingen, Germany

[22] Filed: Sept. 5, 1974

[21] Appl. No.: 503,450

[30] Foreign Application Priority Data

Sept. 11, 1973 Germany ..... 2345705

[52] U.S. Cl. ..... 134/112; 134/173; 134/177; 134/181; 134/191; 134/192; 134/200

[51] Int. Cl.[2] ..... B08B 3/02

[58] Field of Search ..... 134/104, 112, 173, 175, 134/176, 177, 180, 181, 191, 192, 200, 193, 198

[56] References Cited

UNITED STATES PATENTS

| | | | |
|---|---|---|---|
| 1,345,412 | 7/1920 | Smith | 134/173 X |
| 1,511,661 | 10/1924 | Dantzebecher | 134/109 |
| 1,596,969 | 8/1926 | Hedstrom | 134/191 X |
| 1,953,409 | 4/1934 | Hovda | 134/173 |
| 2,565,798 | 8/1951 | Borzell et al. | 134/191 X |

FOREIGN PATENTS OR APPLICATIONS

| | | | |
|---|---|---|---|
| 1,464,961 | 11/1966 | France | 134/180 |
| 1,366,204 | 6/1964 | France | 134/181 |
| 928,552 | 5/1955 | Germany | 134/191 |

*Primary Examiner*—Robert L. Bleutge
*Attorney, Agent, or Firm*—Joseph A. Geiger

[57] ABSTRACT

The invention relates to a dish washing machine, comprising a receptacle which can be opened to one side - preferably upwards - which encloses the wash zone and forms a water reservoir at the bottom, comprising also at least one dish basket or similar device which can be inserted into the wash zone and secured, and an offset spray pipe which passes through the spray zone from bottom to top in a preferably vertical direction, the spray pipe having a number of superposed jets in its side and the bottom of which extends into the water reservoir and contains a water pumping device, in particular a screw-type impeller which is coupled to an electric motor.

14 Claims, 8 Drawing Figures

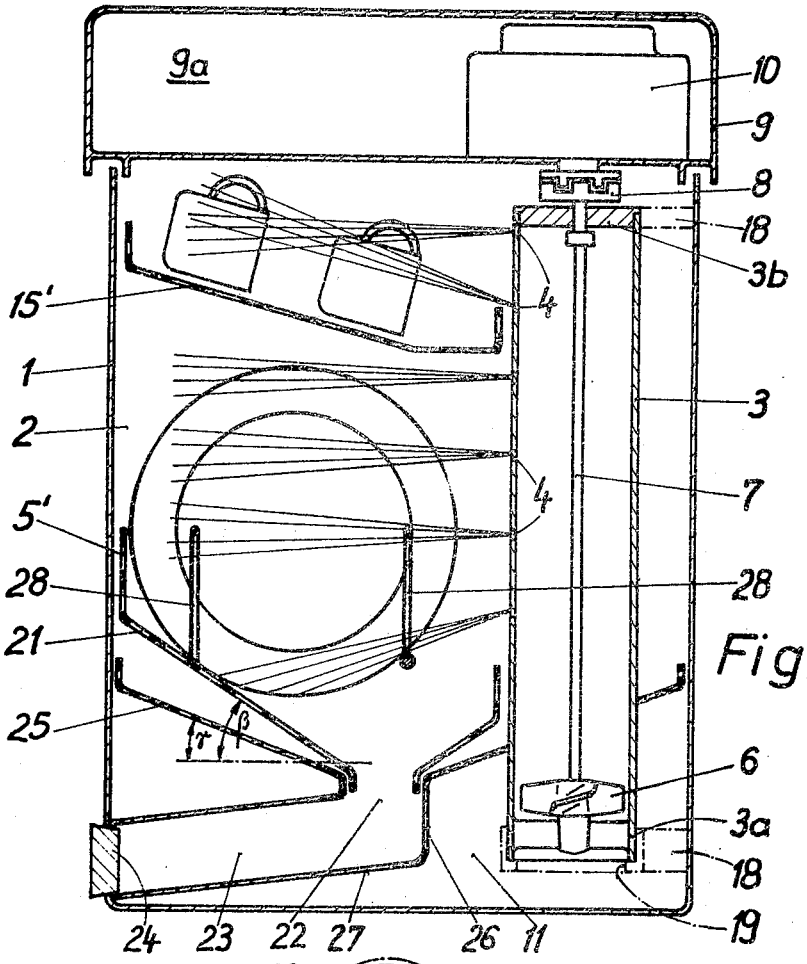
Fig. 5
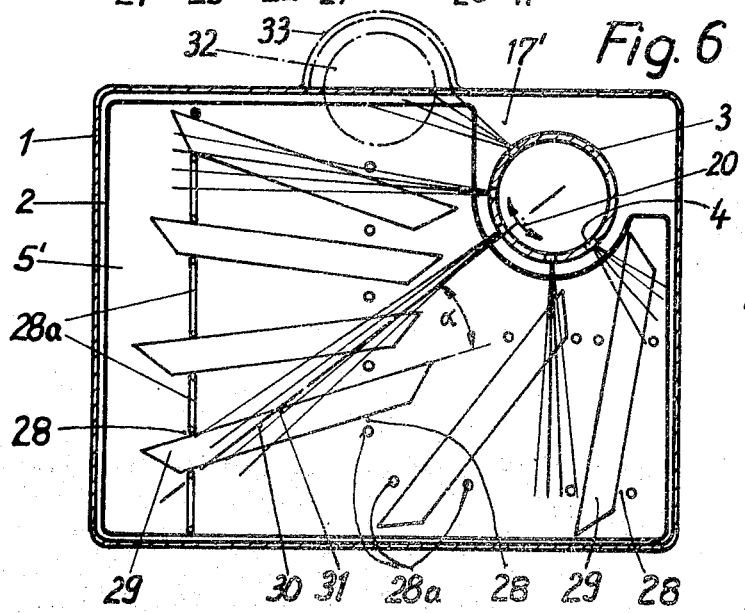
Fig. 6
Fig. 7
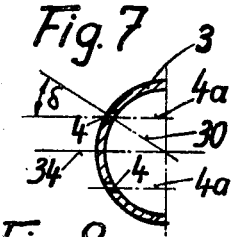
Fig. 8
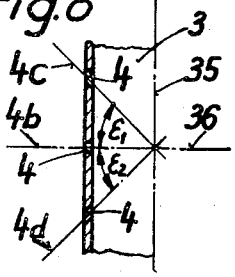

DISH WASHING MACHINE

BACKGROUND TO THE INVENTION

Many different kinds of dish washing machine are known nowadays. One group, which is intended mainly for commercial use, incorporates very advanced and efficient devices with powerful pumping units which produce a powerful water jet and dish baskets which are driven in a rotary direction. However, though efficient, these machines are relatively complicated and expensive. Another group of known dish washing machines are the domestic dish washing machines which are not so powerful but which nevertheless are often just as complicated in design. The invention relates to a dish washing machine within this group of domestic machines, and is characterised by its simplicity in design and restricted to only the most essential functions. Therefore, the invention proposes a simple dish washing machine.

Dish washing machines are known which, to simplify their design, have a horizontal spray pipe which can execute swivel movements, for example under the force of the water jets. This horizontal spray pipe is supplied with water from outside the wash zone, i.e. the circulation of water is partly outside the wash zone, which requires outside pipes, enclosing parts, etc.

SUMMARY OF THE INVENTION

To achieve a simpler design of this type of washing machine, the invention is based on a principle as mentioned above (e.g. as disclosed in U.S. Pat. No. 1,511,661), which existed in the very early stages of dish washing machine design. In this design the circulation of water takes place entirely within the wash zone through a spray pipe which extends through the wash zone from bottom to top and in whose bottom end is located an impeller driven by an electric motor, which raises the water in the spray pipe and squirts it out through lateral orifices. The bottom end of the spray pipe extends into a water reservoir formed by the lower area of the wash zone. This design affords the least flow losses, which enables a relatively low-powered pump to be used. Also, the casing may comprise only one wall all round and may be bin-shaped with a lid, so that the dish baskets can be inserted from above. A more simpler design is therefore possible.

In the known design (U.S. Pat. No. 1,511,661) the spray pipe is arranged vertically in the center of a round receptacle. The dish baskets can be insertable perforated bottoms having a piece cut out in the centre for the spray pipe to pass through, on which the dishes etc. are placed round about the spray pipe. This means that the spray pipe must have jet holes all the way round, and to produce strong jets from all these holes a suitably high-powered pump and/or motor is required.

The invention has the aim of designing a dish washing machine of the above-quoted type which is extremely simple in design and has the circulation of water completely within the wash zone area but which has an improved spray pipe and smaller sized motor and delivery pump, while avoiding the setbacks enumerated above, so that moreover the wash zone can be better utilized for adjusting the dishes.

To accomplish this aim the invention - based on the features aforesaidmentioned - is characterised in that the spray pipe extends from the bottom upwards in an eccentric position from the center vertical axis of the wash zone and is surrounded by up to 180° of the dish basket which can be loaded with crockery, so that the spray pipe need only have holes for this spraying angle.

This affords the advantage that jets of water are not required at all angles but only within an angular range of 180°, and this angular range can be increased if the spray pipe is swivelled about, say by 30°. The result is that less water is needed or alternatively a greater water pressure is available or the electric motor can be a smaller size. All the three aforesaid factors contribute to a greater improvement or simplification in the design of the dish washing machine, and, also, much more space is available next to the spray pipe for adjusting the dish basket or the crockery thereon, equal to the rest of the free width of the receptacle. The spray pipe can be installed near to or on the wall of the receptacle. In a preferred embodiment comprizing a receptacle which is basically square or rectangular in section the spray pipe is located near a corner and is surrounded by about 90° of that part of the dish basket which takes dishes or the like. In this case holes need only be provided in the spray pipe within a particularly small angular range. This means more jet holes can be arranged next to each other, thus increasing the washing effect.

The invention is further developed in that the dish basket has cut outs for taking plates at a certain acute angle in relation to the spray pipe measured by a radial line which passes through the centre of the plates. This acute angle can be preferably 10° – 30°. By positioning the plates in this way the jet of water hit each plate at this acute angle, producing a 'peeling' effect which surprizingly improves the washing effect.

Preferably the spray pipe is closed at its top end, so that the water can only escape radially. Also, the spray pipe can be hinged in a known manner so that it can swivel under the force of the water jets themselves or by the pressure of the water or by a mechanically-actuated mechanism. The swivelling angle can be 5°–60°, which effectively assists the peeling action referred to above.

The invention is also greatly improved if the water pumping device with its drive shaft is mounted inside the spray pipe and between it and the drive motor is installed inside the wash zone a disconnectable clutch. A further development is that the spray pipe together with one half of the clutch is detachably mounted inside the receptacle and can be taken from out of the receptacle together with the water pumping device by disconnecting the clutch. This means that the spray pipe with pumping device is easily taken out of the receptacle as a unit for the purposes of cleaning or for gaining easy access to parts located below this, e.g. a removable fine screen.

Another important improvement is achieved in an embodiment in which the receptacle can be opened at the top and has a lid and the electric motor is installed inside the lid - preferably in a space that is closed off from the wash zone - and the clutch is located at the top of the spray pipe near the lid, the drive shaft passing through the spray pipe and connected to the pumping device. In this way the drive motor is located above the wash zone, which facilitates the sealing of its shaft from the wash zone and reduces the actual height of the bin-shaped receptacle compared to an embodiment in which the motor is arranged below the wash zone. In particular, this has the advantage that after the lid has been opened or detached the dish basket does not have to be lifted so high when removing it from the machine. This easy operation is important when one considers that such simple appliances are usually placed on a table or the like.

BRIEF DESCRIPTION OF THE DRAWINGS

Further details and advantages of the invention are given in the following specification, in the form of embodiments illustrated schematically in the drawings, in which.

DESCRIPTION OF THE PREFERRED EMBOIDMENTS

Figure 1:
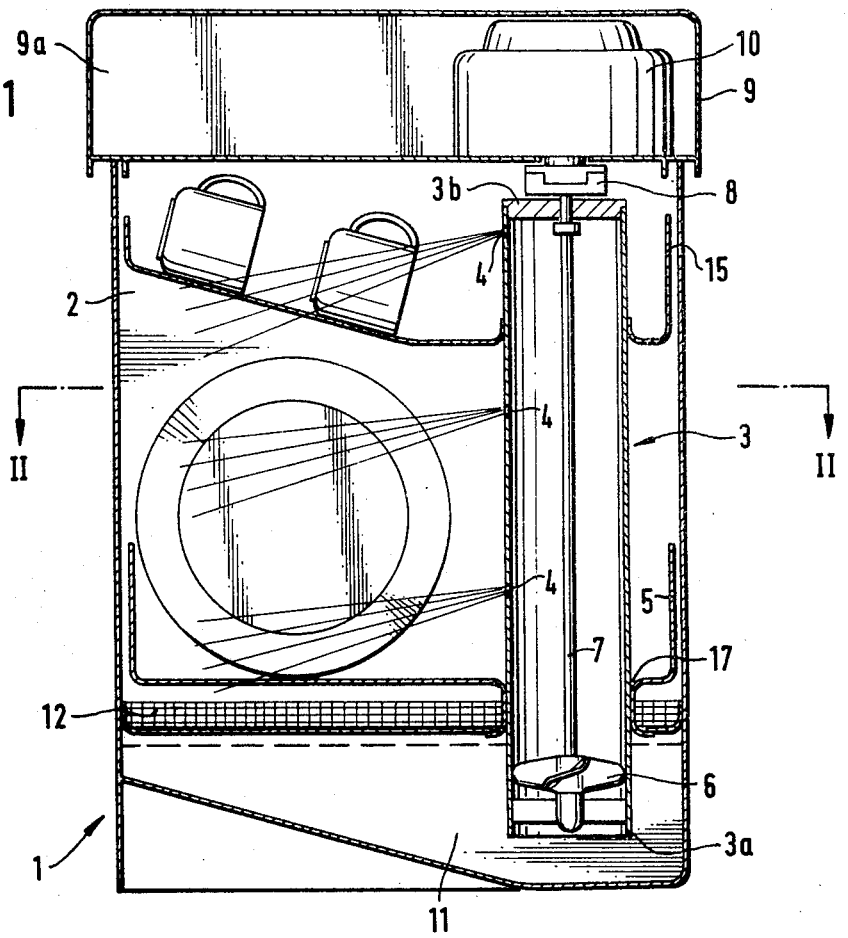
FIGS. 1 and 2 show a first embodiment, FIG. 1 a vertical section through the line I—I in FIG. 2, and FIG. 2 a horizontal section along line II—II in FIG. 1, FIGS. 3 and 4 a second embodiment in the same sections as in FIGS. 1 and 2, FIGS. 5 and 6 a similar representation of a third embodiment, FIG. 7 a horizontal section through a part of the spray pipe of a modified embodiment and FIG. 8 a vertical section through a part of a spray pipe of a further embodiment.
Figure 2:
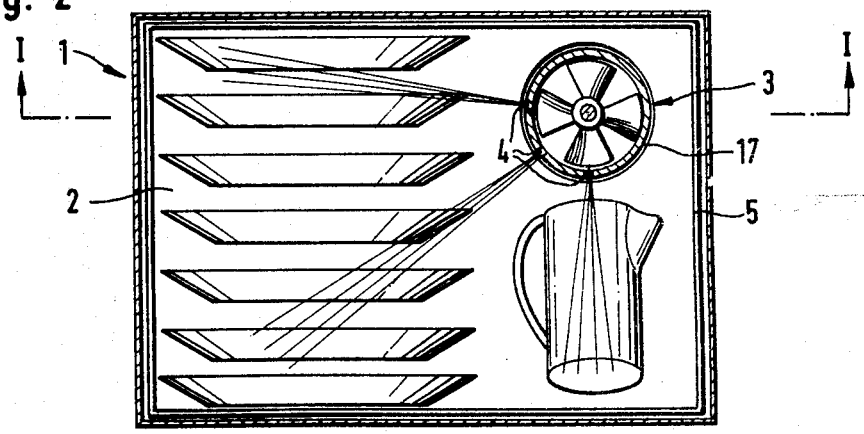

In the embodiment shown in FIGS. 1 and 2 the dish washing machine consists principally of a bin-shaped receptacle 1 which can only be opened from above, which encloses a wash zone 2 and forms a reservoir 11 at the bottom, and consisting also of a detachable lid 9 for the receptacle 1, two superposed dish baskets 5, 15, which are inserted into the wash zone from above, and a vertical spray pipe 3 which passes through the wash zone 2 from the bottom upwards and which has a number of superposed jet holes 4. The bottom end 3*a* of the spray pipe 3 extends into the reservoir 11. Inside it is located the water pumping device 6 in the form of an impeller which is coupled via a drive shaft 7 and a disconnectable clutch 8 to an electric motor 10 housed inside an encapsulated space 9*a* inside the lid 9. The top end 3*b* of the spray pipe 3 is closed off. The drive shaft 7 extends from the water pumping device 6 upwards through the spray pipe 3 and is mounted in bearings at the top and bottom inside the spray pipe. As indicated in FIG. 1, the clutch 8 is located above the top end 3*b* of the spray pipe 3 still within the spray zone 2 near the lid 9.

In the embodiment shown in FIGS. 1 and 2 the spray pipe 3 together with the half of the clutch 8 belonging to the drive shaft 7 can be detached inside the receptacle and taken out along with the water pumping device 6 by disconnecting the clutch 8. In this embodiment, the spray pipe 3 is fixed by the bottom dish basket 5, which has a second bottom in the form of a large-area screen 12 and dished edges pointing upwards.

As shown in FIGS. 1 and 2, the receptacle 1 has a rectangular outline and the vertical spray pipe 3 is eccentrically positioned relative to the vertical center axis of the wash zone 2, that is, near one corner of the receptacle. However, the distance from the latter is so big that the greater diameter of the electric motor 10 can still be housed in the lid 9 without having to make the lid project too far outward from the side of the receptacle 1. The spray pipe 3 positioned in a corner - as illustrated in FIG. 2 - is surrounded by dishes etc. in the dish basket 5 to the extent of about 90°. The same also applies to the upper dish basket 15. Only in this angular range are jet holes 4 provided in the spray pipe 3.

The water in the reservoir 11 of the wash zone 2 is pumped up the spray pipe 3 by the impeller 6, escapes under pressure through the jet holes 4 and splashes radially against the dishes, passes through the large-area screen 12 and returns to the reservoir 11. If the jet holes 4 in the spray pipe 3 get clogged with dirt these can be cleared again by reversing the circulation of the water by reversing the rotation of the motor.

A much easier and safer operation of the dish washing machine is achieved with a spray pipe 3 that can be detached from the lid 9 as opposed to a spray pipe that is fixed to the lid. A means can also be provided whereby the circulation of fluid can only take place when the lid is closed.

Figure 3:
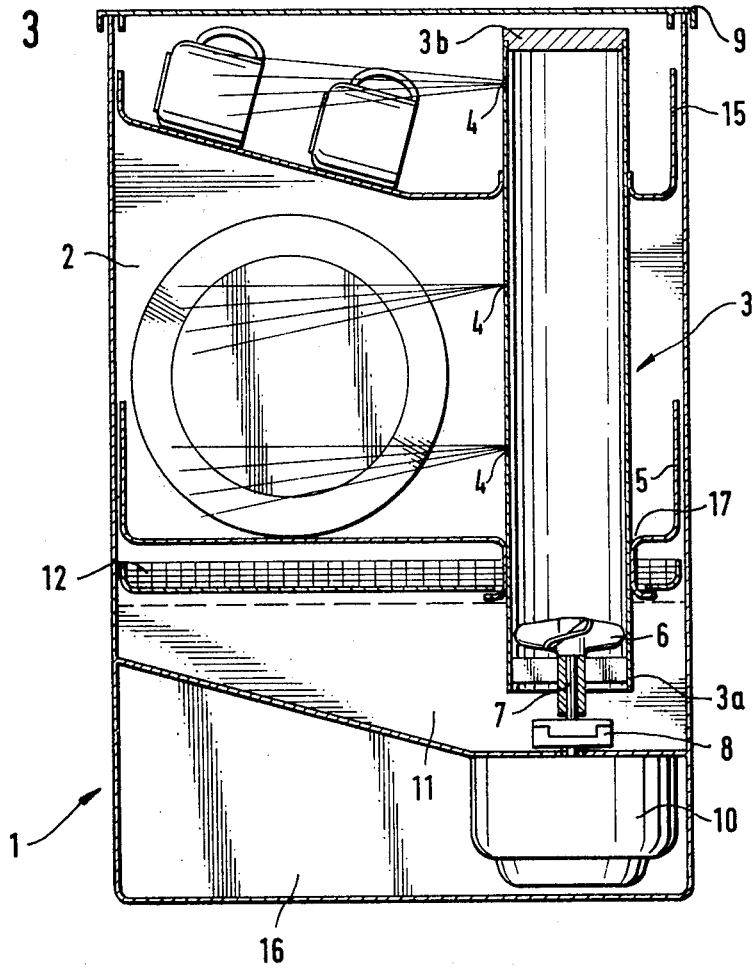
Figure 4:
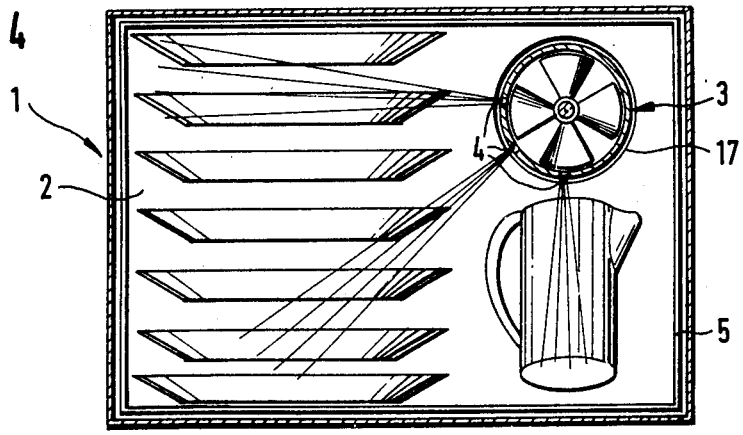

In the embodiment in FIGS. 3 and 4 parts having the same function are designated by the same reference numbers as in FIGS. 1 and 2. Unlike the embodiment in FIGS. 1 and 2 the drive motor 10 is not housed inside the lid 9 but below the reservoir 11 in a special lower space 16 in the receptacle 1.

In the embodiments in FIGS. 1 – 4 the dish baskets 5, 15 have a cutout 17 through which the spray pipe 3 passes. This cutout takes the form of a hole in the dish basket. The spray pipe 3 can be rigidly or detachably held by one or both dish baskets. It is also possible for the spray pipe 3 to be rigidly or detachably held against one side of the wash zone 2. This is illustrated in the embodiment shown in FIGS. 5 & 6. Parts having the same function have the same reference numbers as in FIGS. 1 – 4.

The position of the spray pipe 3 in embodiments in FIGS. 5 & 6 is the same as in the embodiments in FIGS. 1 – 4. The basic design of the spray pipe 3 and position of the electric motor 10 are the same as in the embodiment in FIGS. 1 & 2. Different is that the spray pipe 3 is either rigidly fixed or detachably held to the receptacle 1 by means of shackles 18 represented by dot-dash lines in FIG. 5. The bottom shackle 18 can also support the spray pipe 3 axially by having an inside shoulder 19. However, other means of fixing or holding the spray pipe 3 can be used than that mentioned above. In addition, the holding device and the spray pipe can incorporate a device which effects and to and fro swivelling action of the spray pipe in its peripheral direction (direction of arrow 20 in FIG. 6), in a known way, preferably produced by the jets of water themselves. This swivelling action can be 5° – 60°.

In this embodiment the spray pipe 3 is basically fixed inside the receptacle and taken out after long intervals for cleaning, so dish baskets 5', 15' are provided which have a cutout 17' through which the spray pipe 3 passes and which are open to the adjacent receptacle wall or corner.

Different is also that the bottom of the bottom dish basket 5' is formed as a coarse screen 21 over its total area, which tapers down toward a central depression 22 for catching large bits, at an angle $\beta$ of about 30°. A spacious outlet canal 23 leads away from this, through which large bits can be removed from the depression 22 when the dish basket 5' is inserted and which is closed from outside by a plug 24.

Under the coarse screen 21 is fixed a fine screen 25 which covers the entire surface area of the wash zone 2 and which likewise tapers down to the same depression 22 at an angle $\gamma$ of about 20° to the horizontal. Big bits which are caught by the coarse screen 21 in the first wash slip down its sharp incline into the depression 22 and from there into the outlet canal 23. The depression 22 and the outlet canal 23 have unperforated walls 26, 27, so that large bits resting there do not come into contact with the circulation of water passing through the coarse screen 21 and the fine screen 25. This means that these large bits do not retain so much detergent during subsequent wash operations than would be the case if they were lying open in the wash zone. Furthermore the outlet canal 23 should be opened after the first wash, so that the large bits are rinsed out automatically or can be taken out by hand.

The dish baskets 5, 15 and 5', 15' are made in the usual way frames made of wire or plastic. For reasons of simplicity they are represented only schematically in the drawings, partly as schematic wall screens. As FIG. 6 shows, the dish basket 5' has holding slots 28 for plates 29, which are so arranged that they hold the plate at an acute angle $\alpha$ of preferably approx. 20° to an imaginary radial line 30 from the center of the spray pipe 3 which passes through the center of the plate 31. This acute angle $\alpha$ can be between 10°–30°. In the case of a wire frame these holding slots 28 can be formed by stirrup or rod-shaped parts 28*a* of the dish basket 5', in the case of a plastic basket by appropriately shaped wall cutouts.

Instead of in a corner the spray pipe 3 can be installed in the centre of a side wall of the receptacle 1, such as is represented with a dot-dash line in FIG. 6 at 32. In this case it need only project halfways into the wash zone while the other half is housed in a bulge 33 in the receptacle 1. The cutaway 17' in the dish basket 5', 15' is then made to coincide with position 32 of the spray pipe. The spray pipe is then surrounded by max. 180° of crockery-bearing part of the dish basket 5', 15'. Accordingly, only jet holes for this angular range are provided in the spray pipe. This angular range is increased by the angular freedom of the spray pipe if the latter is slewed. In a corner arrangement such as is illustrated in FIGS. 2, 4 and 6 and arrangement of the jet holes 4 through an angular range of between 90° and 180° will be sufficient. Thus water is only sprayed in this one direction and under a pressure which will be determined by the capacity of the impeller 6. This, together with the special arrangement of the plates according to FIG. 6 at an acute angle $\alpha$ to the radial of the spray pipe 3 produces an effective washing action.

The modification shown in FIG. 7 represents a spray pipe 3 having a wall thickness of about 6 mm. With these relatively thick walls of about 6 mm the jet holes 4 are drilled as holes which have the effect of nozzles, i.e. eject a stream of water which is somewhat strongly beamed in the direction of the hole axis 4*a*. In the embodiment shown in FIG. 7 the axis of the holes 4a to the radial 30 of the spray pipe 3 is offset by an angle $\alpha$ in the peripheral direction. As FIG. 7 shows, there are two jet holes 4 whose axis 4*a* are parallel to each other and to a radial line 34 which passes centrally between them.

In the embodiment shown in FIG. 8 the jet holes 4 have their axis 4*b*, 4*c* or 4*d* either parallel to a plane 36 which is perpendicular to the longitudinal axis 35 of the spray pipe 3, or which are inclined to the said plane by an angle $\epsilon_1$ upward or an angle $\epsilon_2$ downward. This enables special spraying effects to be achieved, as demonstrated in FIG. 5 with the water jets shown therein.

Modifications through the use of technical equivalents are of course possible within the scope of the invention. For example, the spray pipe 3 can be mounted directly against the wall of the receptacle. It is also possible to instal the spray pipe at an angle if it is made sure that it passes through the wash zone 2 from the bottom upwards, that its bottom end extends into the water reservoir 11 and sucks up water and sprays this essentially throughout the entire height of the wash zone.

The receptacle 1 can instead of having a lid 9 have a side opening with hinged door. It is not absolutely necessary that the spray pipe 3 has a cylindrical form. It can have a bulge preferably located in its mid-portion and having a spherical shape for instance, the jet holes being only in the area of said bulge.

I claim:

1. A compact, self-contained dish washing machine comprising:

a watertight machine housing including: a bottom, substantially vertical side walls enclosing a space of generally rectangular cross-sectional outline, and a removable matching top cover; the housing further defining in its bottom portion a reservoir space or well and a dry space between its well and the level on which the housing is normally supported if resting on a flat surface;

at least one removable dish rack arranged in said housing so as to be capable of holding dishes and other articles within the spray zone;

a substantially vertically oriented spray pipe arranged inside said housing in the vicinity of a side wall thereof, the spray pipe having its lower end reaching into the water which is normally contained in said well and its upper end closed and located near the top of the housing;

a plurality of spray orifices arranged on the periphery of the spray pipe, at such vertical locations and angular orientations that the sprays exiting therefrom under pressure collectively cover an effective spray zone of substantially no more than 180 degrees angular extent from the spray pipe axis and of a vertical extent which covers at least a major portion of said enclosed housing space;

a pump impeller carried by and journalled inside said immersed spray pipe portion on a vertical impeller shaft;

an electric motor arranged in said dry space underneath the well so as to have its shaft axially aligned with the impeller shaft, the motor shaft extending sealingly through the housing wall which separates the well from the dry space; and an axially disengageable coupling between the impeller shaft and the motor shaft, the coupling being arranged inside the well, near the bottom thereof.

2. A dish washing machine as defined in claim 1, wherein the spray pipe is arranged near a corner of the rectangular housing space; and the angular extent of the spray zone is considerably less than 180°.

3. A dish washing machine as defined in claim 2, wherein a dish rack has a rectangular overall outline which corresponds to the housing cross section; and one of the four corners of the dish rack is recessed inwardly to accommodate the spray pipe.

4. A dish washing machine as defined in claim 1, wherein the spray pipe is mounted against a housing wall.

5. A dish washing machine as defined in claim 4, wherein the spray pipe is arranged near the vertical center line of a housing side wall; and a dish rack has a rectangular overall outline which corresponds to the housing cross section and a laterally open central recess in the area of the spray pipe.

6. A dish washing machine as defined in claim 1, wherein a dish rack includes holding fingers for plates or flat dishes; and the holding fingers are so arranged with respect to the spray orifices of the spray pipe that a major portion of the water sprayed against a particular plate impinges thereupon at an acute angle.

7. A dish washing machine as claimed in claim 6, wherein said impingement angle is between 10° and 30°.

8. A dish washing machine as defined in claim 1, wherein the spray pipe is rotatably journalled with respect to the housing; and the dish washing machine further includes means for imparting to the spray pipe a reciprocating swivelling motion.

9. A dish washing machine as defined in claim 1, wherein the spray orifices are constituted by spray nozzles; and the spray axes of at least some of the spray nozzles are inclined with respect to radial lines through said nozzles which perpendicularly intersect the spray pipe axis; said inclined spray axes, when projected onto radial and axial planes through the spray pipe, forming an angle with said radial lines in at least one of said planes.

10. A dish washing machine as defined in claim 9, wherein the spray nozzles are formed by bores in the wall of the spray pipe, the length of said bores being at least twice their diameter.

11. A dish washing machine as defined in claim 1, wherein the spray pipe, pump impeller, impeller shaft and the associated coupling portion are removable from the machine housing as a unit.

12. A dish washing machine as defined in claim 1, wherein a dish rack is arranged in the area of the lower end of the spray zone and has a generally funnel-shaped screen bottom extending over at least a major portion of the housing cross section; and the housing further includes a fixed outlet channel extending across its well and leading from a centrally located opening in said screen bottom of the dish rack to a closable discharge port outside the housing wall.

13. A dish washing machine as defined in claim 12, wherein the funnel-shaped screen bottom of the dish rack has a funnel outline which is inclined from a horizontal plane by an angle of approximately 20° to 45°, the screen having comparatively large openings;

a housing further includes a fixed funnel-shaped screen bottom located underneath the screen bottom of the dish rack, its funnel outline being similarly inclined from a horizontal plane and attached to and opening into the centrally located end of said outlet channel, its screen having comparatively small openings.

14. A dish washing machine as defined in claim 1, wherein the spray pipe has a generally bulb-shaped, enlarged midportion; and said spray orifices are primarily concentrated in said enlarged pipe midportion.

* * * * *